US010612739B2

(12) United States Patent
Zanma et al.

(10) Patent No.: US 10,612,739 B2
(45) Date of Patent: Apr. 7, 2020

(54) VEHICULAR LAMP

(71) Applicant: Stanley Electric Co., Ltd., Tokyo (JP)

(72) Inventors: Yasuyuki Zanma, Tokyo (JP); Takayuki Hashimoto, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/110,408

(22) Filed: Aug. 23, 2018

(65) Prior Publication Data

US 2019/0063710 A1 Feb. 28, 2019

(30) Foreign Application Priority Data

Aug. 24, 2017 (JP) ..... 2017-160850

(51) Int. Cl.

| | |
|---|---|
| ***F21S 41/24*** | (2018.01) |
| ***F21S 41/141*** | (2018.01) |
| ***F21S 41/29*** | (2018.01) |
| *F21Y 115/10* | (2016.01) |

(52) U.S. Cl.

CPC ..... *F21S 41/24* (2018.01); *F21S 41/141* (2018.01); *F21S 41/29* (2018.01); *F21Y 2115/10* (2016.08)

(58) Field of Classification Search

CPC ..... F21S 43/235; F21S 43/236; F21S 10/005; F21S 41/29; G02B 6/0075–008

See application file for complete search history.

(56) References Cited

U.S. PATENT DOCUMENTS

| | | | | |
|---|---|---|---|---|
| 2004/0109326 | A1* | 6/2004 | Uhl | G02B 6/001 362/551 |
| 2010/0149828 | A1* | 6/2010 | Koizumi | F21S 43/14 362/512 |
| 2018/0003882 | A1* | 1/2018 | Paroni | B60Q 3/62 |
| 2018/0119914 | A1* | 5/2018 | Mayer | F21S 41/635 |

FOREIGN PATENT DOCUMENTS

| | | |
|---|---|---|
| JP | 2014-154219 A | 8/2014 |
| JP | 2016-4667 A | 1/2016 |

* cited by examiner

*Primary Examiner* — Julie A Bannan

(74) *Attorney, Agent, or Firm* — Kenealy Vaidya LLP

(57) ABSTRACT

Provided is a vehicular lamp capable of achieving cost reduction by improving assembling workability and reducing the number of parts. The vehicular lamp includes a housing and an outer lens that covers the front opening of the housing to define a light chamber; and an LED, a light guide inner lens that guides light emitted from the LED, a light source substrate on which the LED is mounted, an extension arranged around the light guide inner lens, and a power supply unit fixed to the housing, which are accommodated in the light chamber. The light guide inner lens is composed of first and second divided pieces that are arranged in an axial direction of the light guide inner lens, and the first divided piece is fixed to the housing together with the light source substrate and the second divided piece is fixed to the extension.

10 Claims, 6 Drawing Sheets

VEHICULAR LAMP

This application claims the priority benefit under 35 U.S.C. § 119 of Japanese Patent Application No. 2017-160850 filed on Aug. 24, 2017, which is hereby incorporated in its entirety by reference.

TECHNICAL FIELD

The presently disclosed subject matter relates to a vehicular lamp provided with a light guiding body for guiding light emitted from a light source.

BACKGROUND ART

For example, some headlamps disposed on the left and right of the front portion of a vehicle are configured so as to obtain a desired light distribution by guiding light having a high directivity emitted from a light-emitting diode (LED) to the inside of a light guiding body and causing the light to be outputted from the light guiding body. Examples of such headlamps may include those disclosed in Japanese Patent Application Laid-Open Nos. 2014-154219 and 2016-004667. One of examples of such a vehicular lamp is shown in FIG. 1.

FIG. 1 is a cross-sectional side view of a conventional vehicular lamp, and the illustrated vehicular lamp 101 is used as a headlamp. As illustrated in FIG. 1, the vehicular lamp 101 is configured to include an LED 105 serving as a light source, a light source substrate 106*a* for use in mounting the LED 105, a control substrate 106*b* for driving and controlling the LED 105, a light guide inner lens 107 of such as a rod, a prism, a plate, or a different shape which is a light guiding body arranged horizontally along the vehicle front-rear direction (left-right direction in FIG. 1), and an extension 108 arranged around the light guide inner lens 107, which are all accommodated in a lamp chamber 104 defined by a housing 102 and a transparent outer lens 103 covering the front opening of the housing 102.

The light guide inner lens 107 is disposed substantially at the center in the lamp chamber 104, and has a parabolic incidence surface 107*a* formed at the rear end thereof in the longitudinal direction (right end in FIG. 1). The light guide inner lens 107 further has a two-step curved emission surface 107*b* having cuts for use in controlling light distribution and formed at the front end in the longitudinal direction (left end in FIG. 1). The light guide inner lens 107 is fixed to the extension 108 at the middle portion in the longitudinal direction.

The light guide inner lens 107 has a boss 107*c* formed at the longitudinal rear end of the light guide inner lens 107. The light source substrate 106*a* of a flat plate shape is fixed to the boss 107*c*. The LED 105 mounted on the light source substrate 106*a* faces the incident surface 107*a* of the light guide inner lens 107.

The control substrate 106*b* of a flat plate shape is vertically fixed to the housing 102 at the rear of the light source substrate 106*a*. Here, an external input connector 109 is inserted through and held in the rear wall of the housing 102, and a maintenance hole 102*c* is formed in a predetermined portion of the bottom wall of the housing 102 (a position below the light source substrate 106*a* and the control substrate 106*b*). The hole 102*c* is normally closed by a cap 115.

Furthermore, the light source substrate 106*a* and the control substrate 106*b* are electrically connected to each other by a cord 112, and the control substrate 106*b* is electrically connected to the external input connector 109 held by the housing 102 by another cord 113. The external input connector 109 is electrically connected to a power source (not illustrated) such as a battery by a code (not illustrated).

In the vehicular lamp 101 configured as described above, when electric power is supplied from a battery (not illustrated) to the LED 105 through the external input connector 109, the cord 113, the control substrate 106*b*, the cord 112, and the light source substrate 106*a*, the LED 105 is activated to emit light. The light emitted from the LED 105 toward the front of the vehicle (left side in FIG. 1) enters the light guide inner lens 107 through the incident surface 107*a* of the light guide inner lens 107. The light having entered the light guide inner lens 107 travels as parallel light toward the front of the vehicle in the light guide inner lens 107, and exits through the emission surface 107*b* of the light guide inner lens 107 toward the front of the vehicle while being diffused to the periphery. In this manner, the light distribution is controlled, so that the light passes through the transparent outer lens 103, and is irradiated toward the front of the vehicle. As a result, the vehicular lamp 101 functions as a headlamp.

Here, a method of assembling the vehicular lamp 101 will be described below with reference to FIGS. 2 and 3.

FIG. 2 is a cross-sectional side view illustrating a state before assembly of a conventional vehicular lamp, and FIG. 3 is a cross-sectional side view illustrating a state during assembly (cord connection) of the vehicular lamp. In assembling the vehicular lamp 101, before assembling the outer lens 103 to the housing 102, as shown in FIG. 2, the outer lens 103, the extension 108 accommodated therein, a lens unit U1 composed of the light guide inner lens 107 fixed to the extension 108 and the light source substrate 106*a* fixed to the light guide inner lens 107, and a housing unit U2 composed of the control substrate 106*b* fixed to the housing 102 are individually prepared. As shown in FIG. 3, the lens unit U1 and the housing unit U2 are assembled; however, in a state where both units have been assembled in this manner, one end of the cord 112, the other end of which has been connected to the light source substrate 106*a*, is in a free state, so that it is necessary to connect the one end of the cord 112 to the control substrate 106*b*. As shown in FIG. 3, this operation is performed by removing the cap 115 fixed to the housing 102 to open the maintenance hole 102*c* formed in the housing 102, and inserting a hand of an operator into the housing 102 through the hole 102*c* to connect the cord 112 to the control substrate 106*b*.

However, in the conventional vehicular lamp 101 illustrated in FIG. 1, it is necessary to detach the cap 115 and connect the cord 112 to the control substrate 106*b* in a state where the lens unit U1 and the housing unit U2 are assembled as illustrated in FIG. 3. Accordingly, there has been a problem that, in addition to the troublesome operations and increased assembly process steps, the number of components increases because the cord 112 and the cap 115 are necessary, resulting in cost increase.

SUMMARY

The presently disclosed subject matter was devised in view of these and other problems and features in association with the conventional art. According to an aspect of the presently disclosed subject matter, there can be provided a vehicular lamp capable of achieving cost reduction by improving assembling workability and reducing the number of parts.

According to another aspect of the presently disclosed subject matter, a vehicular lamp can include a housing having a front opening and an outer lens configured to cover the front opening of the housing to define a light chamber; and a light source, a light guiding body configured to guide light emitted from the light source, a light source substrate on which the light source is mounted, an extension arranged around the light guiding body, and a power supply unit fixed to the housing, which are accommodated in the light chamber. In this vehicular lamp, the light guiding body may be composed of a first divided piece and a second divided piece that are arranged in an axial direction of the light guiding body, and the first divided piece may be fixed to the housing together with the light source substrate and the second divided piece may be fixed to the extension.

In the vehicular lamp with the above-described configuration, the first and second divided pieces may be two divided pieces having respective shapes corresponding to those obtained from a single light guiding body by cutting the single light guiding body along a plane perpendicular to the axis of the single light guiding body and each have a center axis arranged to coincide with each other to be aligned in a single line.

Alternatively, in the vehicular lamp with the above-described configuration, the first and second divided pieces may be arranged in a staggered and parallel manner in a vertical direction so that the center axes thereof are parallel to each other while parts thereof overlap each other in the axial direction. The parts of the first and second divided pieces where they overlap each other may be cut to form an inclined surface serving as a total reflection surface.

In the vehicular lamp with the above-described configuration, the light source substrate and the control substrate connected to the power supply unit may be integrated to be a common substrate.

According to the aforementioned aspect, since the light guiding body can be composed of two divided pieces arranged in the axial direction, one of the divided pieces of the light guiding body, or the first divided piece can be fixed to the housing together with the light source substrate, and the other of the divided pieces, or the second divided piece can be fixed to the extension. Thus, the wiring work of the cord at the time of assembling the vehicular lamp can be eliminated, the assembling workability can be improved, and the number of work steps can be reduced.

According to the aforementioned aspect with the alternative embodiment described above, since the two divided pieces of the light guiding body are arranged in a staggered and parallel manner with each other in the vertical direction in such a manner that the two divided pieces partially overlap with each other in the axial direction, it is possible to arrange the light guiding body in the lamp chamber while avoiding interference with other components (obstacles). Light having entered the first divided piece of the light guiding body from the light source can be totally reflected by the total reflection surface formed on the first divided piece toward the second divided piece, and can then be incident on the second divided piece. Since the light having entered the second divided piece can be totally reflected by the total reflection surface formed on the second divided piece and travel in parallel with the axial direction inside the divided piece, the two divided pieces of the light guiding body can achieve an originally intended light guiding function.

According to the aforementioned aspect in another embodiment described above, the cord for connecting the light source substrate and the control substrate, the maintenance hole formed in the housing, and the cap for closing the hole are unnecessary. In addition to this, the light source substrate and the control substrate are integrated as a single common substrate, so that the number of components is reduced and the cost of the vehicle lamp is reduced.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to a vehicular lamp of the presently disclosed subject matter with reference to the accompanying drawings in accordance with exemplary embodiments.

It should be noted that the directions are basically defined assuming that the vehicular lamp is mounted in a vehicle body as a headlamp, and the "front direction" used herein is defined to be a light emitting direction of the vehicular lamp, and upward, downward, left, right, and rear directions are based on the front direction with the installed vehicular lamp.

First Exemplary Embodiment

Figure 1:
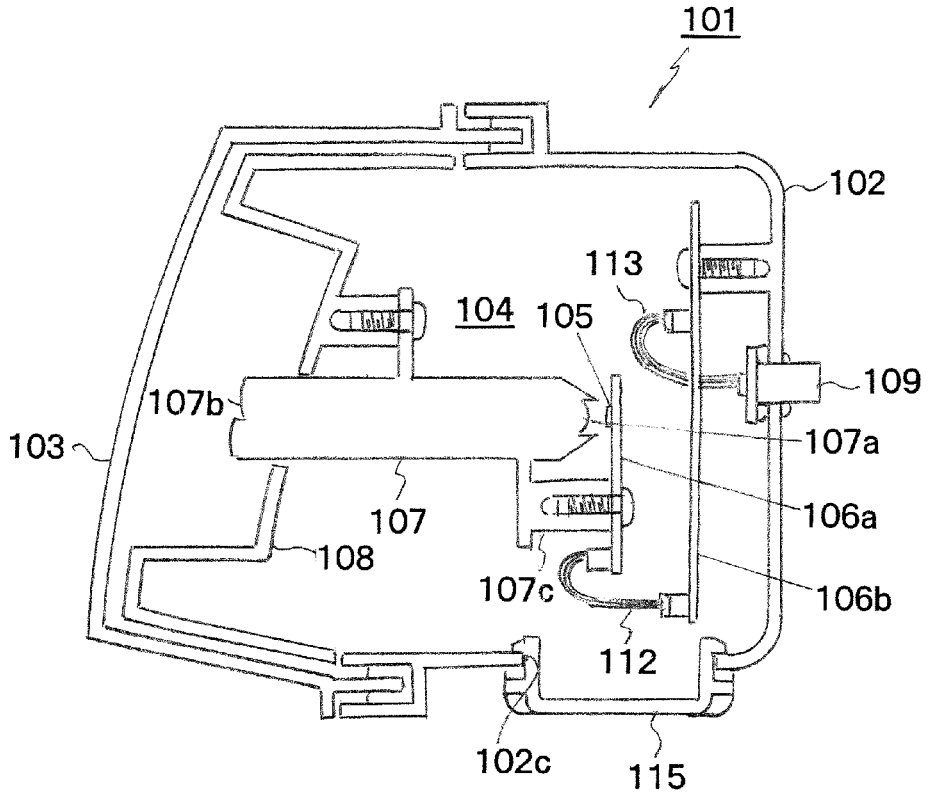
FIG. 1 Conventional Art
FIG. 1 is a cross-sectional side view of a conventional vehicular lamp.
Figure 2:
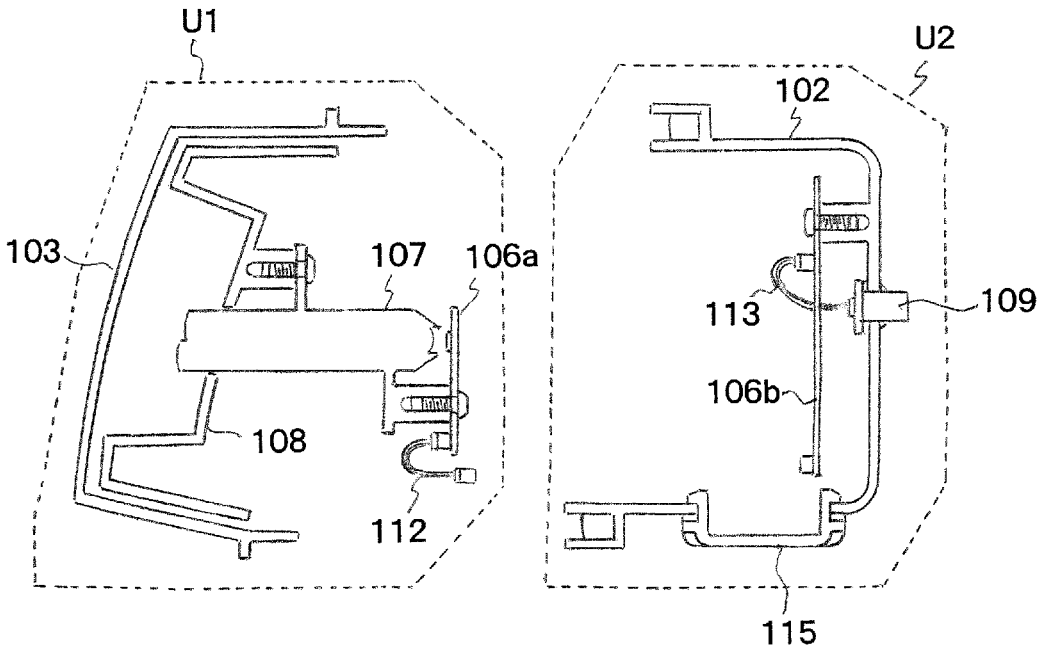
FIG. 2 Conventional Art
FIG. 2 is a cross-sectional side view illustrating a state before assembly of the conventional vehicular lamp.
Figure 3:
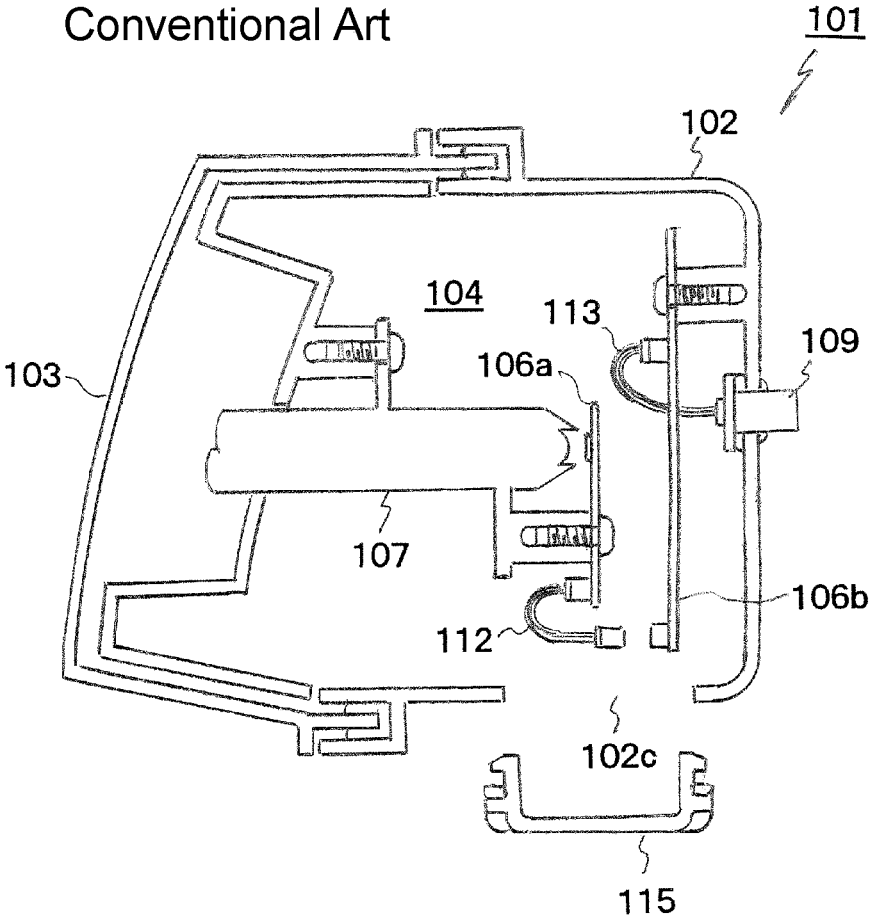
FIG. 3 Conventional Art
FIG. 3 is a cross-sectional side view illustrating a state during assembly of the conventional vehicular lamp.
Figure 4:
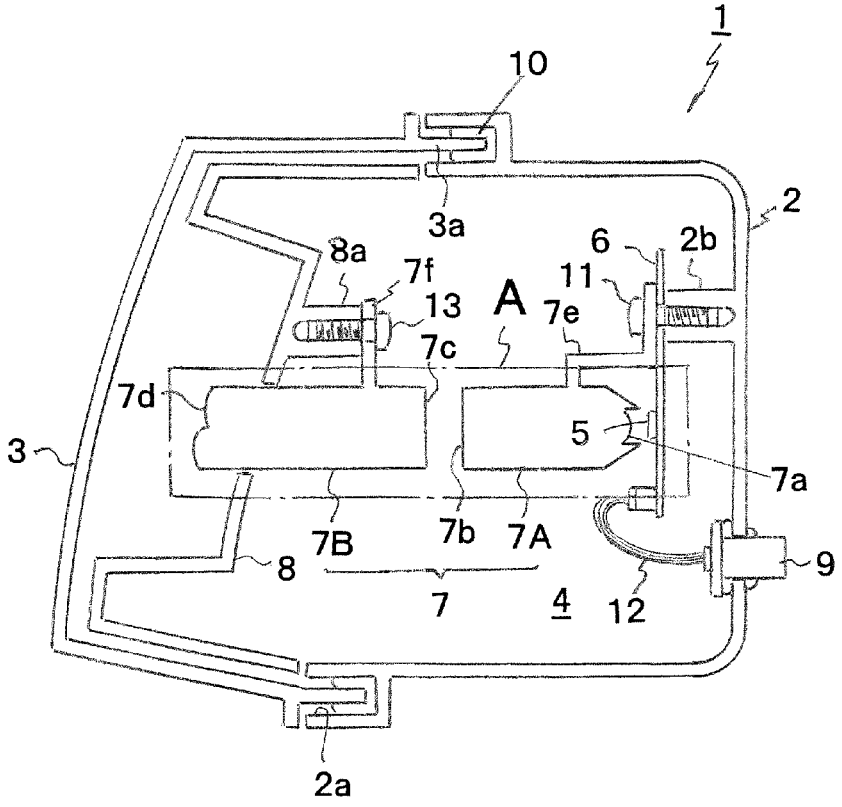
FIG. 4 is a cross-sectional side view of a vehicular lamp according to a first exemplary embodiment made in accordance with principles of the presently disclosed subject matter.
Figure 5:
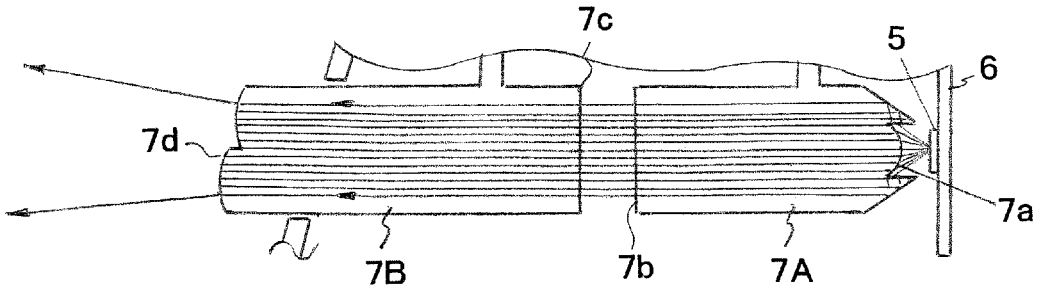
FIG. 5 is an enlarged detailed view of a part A of FIG. 4.
Figure 6:
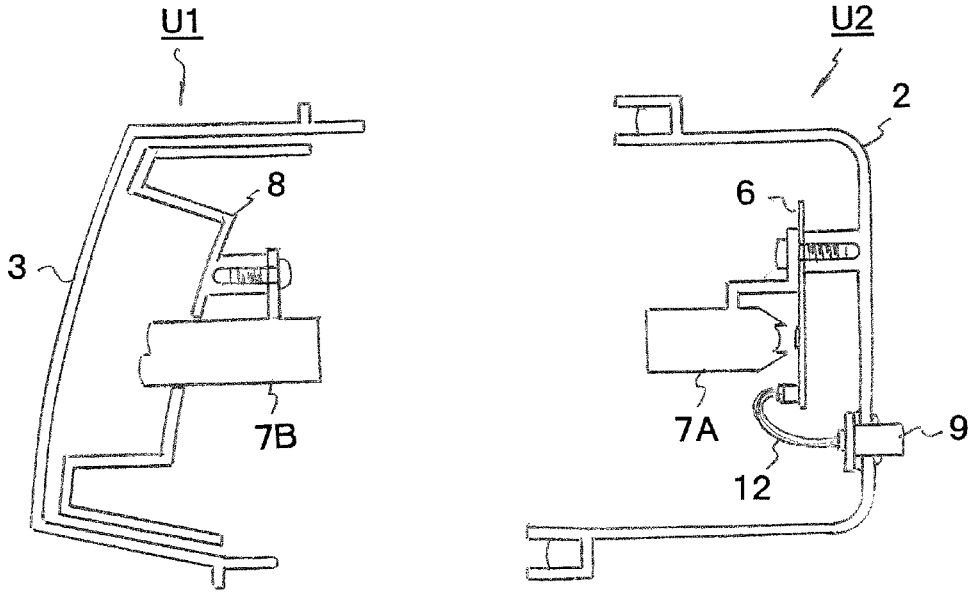
FIG. 6 is a cross-sectional side view showing a state before assembly of the vehicular lamp according to the first exemplary embodiment.

FIG. 4 is a cross-sectional side view of a vehicular lamp according to a first exemplary embodiment made in accordance with the principles of the presently disclosed subject matter; FIG. 5 is an enlarged detailed view of a part A of FIG. 4; and FIG. 6 is a cross-sectional side view showing a state before assembly of the vehicular lamp according to the first exemplary embodiment.

The vehicular lamp 1 according to the present embodiment can be used as a headlamp disposed on the left and right of the front of a vehicle, and as shown in FIG. 4, may be configured by accommodating in a lamp chamber 4 defined by a housing 2 with a front opening and a transparent outer lens 3 that covers the front opening of the housing 2, a light-emitting diode (LED) 5 serving as a light source, a plate-like common substrate 6 formed by integrating a light source substrate on which the LED 5 is mounted and a control substrate for driving and controlling the LED 5, a prismatic light guide inner lens 7 as a light guiding body disposed horizontally in a vehicle front-rear direction (left-right direction in FIG. 4), and an extension 8 disposed around the light guide inner lens 7.

The housing 2 may be molded into a box shape with an opaque resin that does not transmit light, and include a concave groove 2*a* formed around the periphery of the front opening. The housing 2 may further have a boss 2*b* integrally protruded from an upper portion of a rear wall of the housing 2 on an inner surface of the rear wall, and a hole formed in a lower portion of the rear wall below the boss 2*b* through which an external input connector 9 serving as a power supply unit is inserted and held.

The outer lens 3 may be molded with a transparent resin having light transmittance, and have a leg portion 3*a* horizontally protruded rearward at the outer peripheral edge thereof. The outer lens 3 can be fixed to the housing 2 by fitting the leg portion 3*a* of the outer lens 3 into the concave groove 2*a* formed at the peripheral edge of the opening of the housing 2 from the front, and bonding them together with an adhesive 10 such as a hot melt adhesive. As a result, the housing 2 and the outer lens 3 can define a lamp chamber 4 as described above.

The light guide inner lens 7 may be made of a transparent acrylic or polycarbonate resin having a high light guiding property, and horizontally arranged substantially at the center in the lamp chamber 4 as shown in FIG. 4. Specifically, in the present exemplary embodiment, the light guide inner lens 7 is divided into two pieces along a plane perpendicular to an axis of the light guide inner lens 7. That is, the light guide inner lens 7 is divided into two pieces 7A and 7B which are first and second divided pieces 7A and 7B. These first and second divided pieces 7A and 7B are arranged in a straight line in a concentric state so that their central axes coincide with each other, and horizontally in a state in which they are axially separated from each other.

Here, as shown in detail in FIG. 5, a parabolic-shaped incident surface 7*a* may be formed at the rear end in the longitudinal direction of the first divided piece 7A on the rear side of the light guide inner lens 7, and the front end surface in the longitudinal direction of the first divided piece 7A may constitute a planar emission surface 7*b*. In addition, the rear end surface in the longitudinal direction of the second divided piece 7B, which is disposed on the front side, may constitute a planar incident surface 7*c* facing to the planar emission surface 7*b*. A two-step curved emission surface 7*d* to which cuts for light distribution control are applied may be formed at the front end in the longitudinal direction of the second divided piece 7B, that is, at the left end in FIGS. 4 and 5. As shown in FIG. 4, a stay 7*e* bent in a crank shape may be integrally erected upward in the middle portion in the longitudinal direction of the first divided piece 7A of the light guide inner lens 7. With this configuration, the first divided piece 7A can be fixed to the housing 2 together with the common substrate 6 by screwing a screw 11 inserted through the stay 7*e* into the boss 2*b* of the housing 2. Here, the common substrate 6 may be a flat substrate configured by integrating the light source substrate and the control substrate as described above, and the LED 5 mounted thereon is disposed so as to face the incident surface 7*a* of the first divided piece 7A. The common substrate 6 is electrically connected by a cord 12 to the external input connector 9 inserted and held in the rear wall of the housing 2, and the external input connector 9 is electrically connected to a power source (not illustrated) such as a battery by another cord (not illustrated).

On the other hand, a flat stay 7*f* may be integrally erected upward in the middle portion in the longitudinal direction of the second divided piece 7B on the front side of the light guide inner lens 7. With this configuration, the second divided piece 7B can be fixed to the extension 8 by screwing a screw 13 inserted through the stay 7*f* into a boss 8*a* integrally protruded from the extension 8.

In the vehicular lamp 1 illustrated in FIG. 4 configured as described above, when electric power is supplied from a battery (not illustrated) to the LED 5 through the external input connector 9, the cord 12, and the common substrate 6, the LED 5 is activated to emit light. The light emitted from the LED 5 toward the front of the vehicle (left in FIGS. 4 and 5) can enter the first divided piece 7A as parallel light through the incident surface 7*a* of the first divided piece 7A of the light guide inner lens 7, as shown in FIG. 5. The light having entered the first divided piece 7A can travel as parallel light toward the front of the vehicle in the first divided piece 7A, and then exit through the emission surface 7*b* of the first divided piece 7A as parallel light. The light can then enter the second divided piece 7B through the incident surface 7*c* of the second divided piece 7B. The light having entered the second divided piece 7B can travel as parallel light in the second divided piece 7B toward the front of the vehicle, and then exit through the emission surface 7*d* of the second divided piece 7B toward the front of the vehicle while being diffused to the periphery, whereby the light distribution is controlled. The resulting light with the desired light distribution can pass through the transparent outer lens 3 and be irradiated toward the front of the vehicle. As a result, the vehicular lamp 1 according to the present exemplary embodiment can function as a headlamp.

Hereinafter, an assembling method of the vehicular lamp 1 according to the present exemplary embodiment will be described with reference to FIG. 6.

In assembling the vehicular lamp 1, before assembling the outer lens 3 to the housing 2, as shown in FIG. 6, the outer lens 3, the extension 8 accommodated therein, a lens unit U1 composed of the second divided piece 7B of the light guide inner lens 7 fixed to the extension 8, and a housing unit U2 composed of the first divided piece 7A of the light guide inner lens 7 and the common substrate 6 fixed to the housing 2 are individually prepared. In the housing unit U2, the common substrate 6 and the external input connector 9 are electrically connected in advance by a cord 12.

Then, the leg portion 3*a* protruding from the outer peripheral edge of the outer lens 3 included in the lens unit U1 is fit into the concave groove 2*a* formed at the peripheral edge of the opening of the housing 2 included in the housing unit U2, and they are adhered with the adhesive 10, whereby the vehicular lamp 1 illustrated in FIG. 4 is assembled.

Accordingly, in the vehicular lamp 1 according to the present exemplary embodiment, the light source substrate and the control substrate are integrated to serve as the common substrate 6, and the light guide inner lens 7 is divided into two pieces, or the first and second divided pieces 7A and 7B in the axial direction, with the first divided piece 7A being fixed to the housing 2 together with the common substrate 6, and the second divided piece 7B being fixed to the extension 8, so that the wiring work of the cord 12 at the time of assembling the vehicular lamp 1 can be eliminated. As a result, the assembling workability can be improved, and the number of work steps can be reduced. The cord for connecting the light source substrate and the control substrate, the maintenance hole formed in the housing 2, and the cap for closing the maintenance hole are thus unnecessary. In addition to this, since the light source substrate and the control substrate are integrated as a single common substrate 6, the number of components is reduced and the cost of the vehicular lamp 1 can be reduced.

In the present exemplary embodiment, the first and second divided pieces 7A and 7B obtained by dividing the light guide inner lens 7 into two may be made of the same material, but the first divided piece 7A closer to the LED 5, which may be heated by the heat generated by the LED 5 to be high temperature, may be made of a material having high heat resistance such as a glass material, and the second divided piece 7B on the visual side (aesthetic side) may be made of a material having high light guide property such as an acrylic resin and a polycarbonate resin.

Further, in the present exemplary embodiment, an example in which the light source substrate and the control substrate are integrated to serve as the common substrate 6 has been described, but the light source substrate and the control substrate may be made separate so that the control substrate may be connected to the power supply unit, and the control substrate and the light source substrate may be electrically connected to each other.

Second Exemplary Embodiment

A description will now be given of a second exemplary embodiment with reference to FIG. 7.

Figure 7:
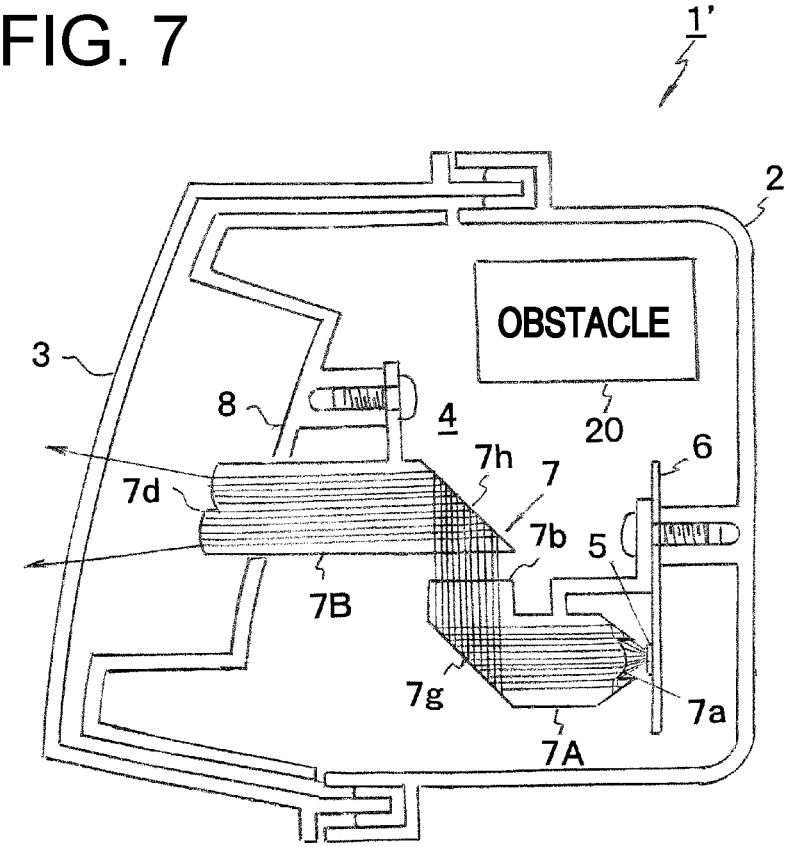
FIG. 7 is a cross-sectional side view of a vehicular lamp according to a second exemplary embodiment of the presently disclosed subject matter.

FIG. 7 is a cross-sectional side view of a vehicular lamp according to the second exemplary embodiment of the presently disclosed subject matter, in which the same components as those illustrated in FIGS. 4 to 6 are denoted by the same reference numerals, and descriptions thereof will be omitted.

In the vehicular lamp 1' according to the present exemplary embodiment, the first and second divided pieces 7A and 7B obtained by dividing the light guide inner lens 7 into two are arranged in in a staggered and parallel manner with each other in the vertical direction in such a manner that the center axes thereof are parallel to each other while parts thereof overlap with each other in the axial direction. Here, the first divided piece 7A on the rear side is disposed in parallel with and horizontally below the second divided piece 7B disposed on the front side, and the overlapping portion (front end portion) of the first divided piece 7A is bent vertically upward toward the second divided piece 7B, and a total reflection surface 7*g* cut at an angle of 45 degrees is formed at a corner portion of the first divided piece 7A. The emission surface 7*b* forming the horizontal surface of the first divided piece 7A is disposed to face the second divided piece 7A disposed immediately above.

On the other hand, a total reflection surface 7*h* cut at an oblique angle of 45 degrees is formed at the overlapping portion (rear end portion) of the second divided piece 7B that is disposed on the front side of the light guide inner lens 7.

In the vehicular lamp 1' according to the present exemplary embodiment, when electric power is supplied to the LED 5 from a power source (not illustrated), the LED 5 is activated to emit light. The light emitted from the LED 5 toward the front of the vehicle can enter the first divided piece 7A through the incident surface 7*a* thereof, travels to the front of the vehicle as parallel light in the first divided piece 7A, and then can be totally reflected by the total reflection surface 7*g*. The light can thus be directed vertically upward by the total reflection surface 7*g*. Then, the light can exit through the emission surface 7*b* of the first divided piece 7A to be directed toward the second divided piece 7B, and enter the second divided piece 7B. Then, the light having entered the second divided piece 7B can be totally reflected by the totally reflecting surface 7*h* formed on the second divided piece 7B, so that its traveling direction is changed to a right angle direction. The light can then travel in the second divided piece 7B as parallel light to the front of the vehicle. The light can then exit through the emission surface 7*d* of the second divided piece 7B to the front of the vehicle while being diffused to the periphery, whereby the light distribution can be controlled. The resulting light with the desired light distribution can pass through the transparent outer lens 3 and be irradiated toward the front of the vehicle. As a result, the vehicular lamp 1' according to the present exemplary embodiment can function as a headlamp.

In the vehicular lamp 1' according to the present exemplary embodiment, since the two divided pieces 7A and 7B obtained by dividing the light guide inner lens 7 into two pieces are arranged in a staggered and parallel manner with each other in the vertical direction while partially overlapping with each other in the axial direction, it is possible to obtain an advantageous effect that the light guide inner lens 7 can be arranged in the lamp chamber 4 while avoiding interference with other components (obstacles) 20.

Although the embodiment of the presently disclosed subject matter is applied to a vehicular lamp used as a headlamp has been described above, it is needless to say that the presently disclosed subject matter is also applicable to any vehicular lamp used for other applications such as a turn signal lamp, a fog lamp, a positioning lamp, and a day running lamp (DRL).

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicular lamp comprising:

a housing having a front opening and an outer lens configured to cover the front opening of the housing to define a light chamber; and a light source, a light guiding body configured to guide light emitted from the light source, a light source substrate on which the light source is mounted, an extension arranged around the light guiding body, and a power supply unit fixed to the housing, which is accommodated in the light chamber, wherein the light guiding body is composed of a first divided piece and a second divided piece that are arranged in an axial direction of the light guiding body, the first divided piece of the light guiding body has an incident surface that is formed at a rear end thereof and through which the light emitted from the light source enters, and an emission surface formed at a front end thereof, and is fixed to the housing together with the light source substrate to constitute a housing unit, the second divided piece of the light guiding body has an incident surface that is formed at a rear end thereof and through which the light having exited through the emission surface of the first divided piece enters, and an emission surface formed at a front end thereof and is fixed to the extension, the emission surface of the second divided piece of the light guiding body being formed as a two or more-step curved surface for light distribution control so that the light exits forward while being diffused to the periphery, the extension and the second divided piece of the light guiding body fixed to the extension constitute a lens unit accommodated in the outer lens, and an outer peripheral edge of the outer lens and a peripheral edge of the opening of the housing are adhered with each other so that the lens unit is located in front of the housing unit.

2. The vehicular lamp according to claim 1, wherein the first and second divided pieces are two divided pieces having respective shapes corresponding to those obtained from a single light guiding body by cutting the single light guiding body along a plane perpendicular to an axis of the single light guiding body and each have a center axis arranged to coincide with each other to be aligned in a single line.

3. The vehicular lamp according to claim 1, wherein the first and second divided pieces are arranged in a staggered and parallel manner in a vertical direction so that center axes thereof are parallel to each other while parts thereof overlap each other in the axial direction, and the parts of the first and second divided pieces where they overlap each other are cut to form an inclined surface serving as a total reflection surface.

4. The vehicular lamp according to claim 1, comprising a common substrate commonly serving as the light source substrate and a control substrate connected to the power supply unit.

5. The vehicular lamp according to claim 2, comprising a common substrate commonly serving as the light source substrate and a control substrate connected to the power supply unit.

6. The vehicular lamp according to claim 3, comprising a common substrate commonly serving as the light source substrate and a control substrate connected to the power supply unit.

7. The vehicular lamp according to claim 1, wherein the first divided piece and the second divided piece of the light guiding body are made of different materials.

8. The vehicular lamp according to claim 1, wherein the light guiding body is used to control at least a part of light distribution of light from any one selected from the group consisting of a headlamp, a turn signal lamp, a fog lamp, a positioning lamp, and a day running lamp (DRL).

9. A production method for the vehicular lamp according to claim 1, comprising;

a step (A) of preparing the housing unit by fixing the first divided piece of the light guiding body to the housing together with the light source substrate;

a step (B) of preparing the lens unit by fixing the second divided piece of the light guiding body to the extension, and then accommodating the extension, to which the second divided piece has been fixed, in the outer lens; and a step (C) of fixing the lens unit prepared in the step (B) to the housing unit from a front side of the housing unit prepared in the step (A), so that the housing and the outer lens are fixed to each other and simultaneously the first divided piece and second divided piece of the light guiding body are positioned so that the light from the light source enters the first divided piece through the incident surface of the first divided piece and the light having exiting through the emission surface of the first divided piece enters the second divided piece through the incident surface of the second divided piece.

10. The production method according to claim 9, wherein an external input connector is held in a rear wall of the housing, and the step (A) include a sub-step of electrically connecting the light source substrate to the external input connector.

* * * * *